US006688347B1

(12) United States Patent
Selby

(10) Patent No.: US 6,688,347 B1
(45) Date of Patent: Feb. 10, 2004

(54) SELF-SUPPORTING, ADJUSTABLE FUNNEL

(76) Inventor: Theodore W. Selby, 4402 Arbor Dr., Midland, MI (US) 48640

( * ) Notice: Subject to any disclaimer, the term of this patent is extended or adjusted under 35 U.S.C. 154(b) by 0 days.

(21) Appl. No.: 10/355,519

(22) Filed: Jan. 31, 2003

Related U.S. Application Data

(60) Provisional application No. 60/353,338, filed on Feb. 1, 2002.

(51) Int. Cl.[7] ..... B65B 39/00; B67C 11/04

(52) U.S. Cl. ..... 141/340; 141/331; 141/337

(58) Field of Search ..... 141/331–345; 248/94, 171, 435; 184/1.5, 106

(56) References Cited

U.S. PATENT DOCUMENTS 299,513 A * 6/1884 Bolton ..... 141/340
2,703,670 A * 3/1955 Voight ..... 141/340
3,211,195 A * 10/1965 Porter ..... 141/337
4,054,184 A * 10/1977 Marcinko ..... 184/1.5
4,245,666 A * 1/1981 Norris ..... 137/357

* cited by examiner

*Primary Examiner*—Timothy L. Maust
(74) *Attorney, Agent, or Firm*—Christopher John Rudy

(57) ABSTRACT

Self-supporting and/or adjustable funnel device includes a funnel to which is attached or has integrally with the funnel a support for holding the device in place. As an alternative or in addition, the device may be adjustable, for instance, by having a contrivance added to or incorporated with the support to make it able to have its orientation vary from a first orientation.

17 Claims, 1 Drawing Sheet

SELF-SUPPORTING, ADJUSTABLE FUNNEL

This claims benefit under 35 USC 119(e) of U.S. provisional patent application No. 60/353,338 filed on Feb. 1, 2002 A.D. The specification of that application is incorporated herein by reference, in its entirety,

FIELD

The present invention concerns a funnel, which may be self-supporting or adjustable, or both.

BACKGROUND

The filling of storage drums such as 55-gallon drums, for example, with test coil samples, can be problematic. Even with a standard funnel, which can improve efficiency to a degree, as is known, problems in spillage during the filling can occur, often as stabilization of known funnels can require one hand, which leaves only one hand to pour from an often unwieldy vessel.

It would be desirable to ameliorate or overcome such problems.

SUMMARY

The present invention provides a self-supporting and/or adjustable funnel device comprising a funnel to which is attached or has integrally therewith a support for holding the device in place. As an alternative or in addition, the device may be adjustable, for instance, by having a contrivance added to or incorporated with the support to make it able to have its orientation vary from a first orientation.

The invention is useful in liquid transfer.

Significantly, by the invention, problems in the art are ameliorated if not overcome. Liquids can be transferred by a single operator in a "hands-free" operation as concerns the funnel. The funnel may be adjusted to various orientations to suit particular circumstances of storage space, storage vessels, and pouring vessels. The invention is simple in manufacture and use. Numerous further advantages attend the invention.

DRAWINGS

The drawings form part of the specification hereof. With respect to the drawings, which are not necessarily drawn to scale, the following is briefly noted.

ILLUSTRATIVE DETAIL

The invention can be further understood by the present detail, which may be read in view of the drawings. Such is to be taken in an illustrative and not necessarily limiting sense.

In general, the self-supporting and/or adjustable funnel device includes a funnel to which is attached or has integrally with the funnel a support for holding the device in place. As an alternative or in addition, the device may be adjustable, for instance, by having a contrivance added to or incorporated with the support to make it able to have its orientation vary from a first orientation.

Figure 1:
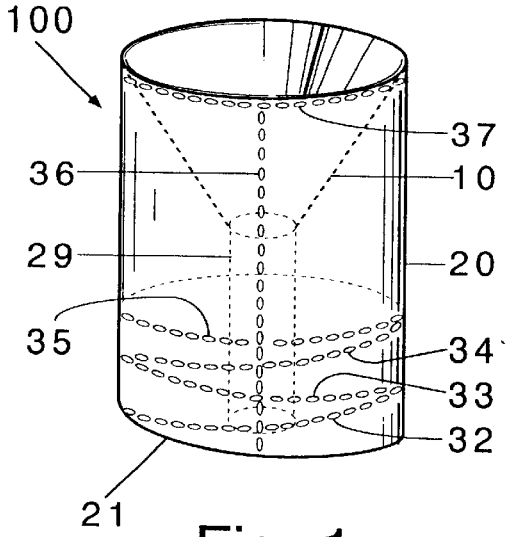
FIG. 1 is a plan view of a self-supporting, adjustable funnel of the invention.
Figure 2:
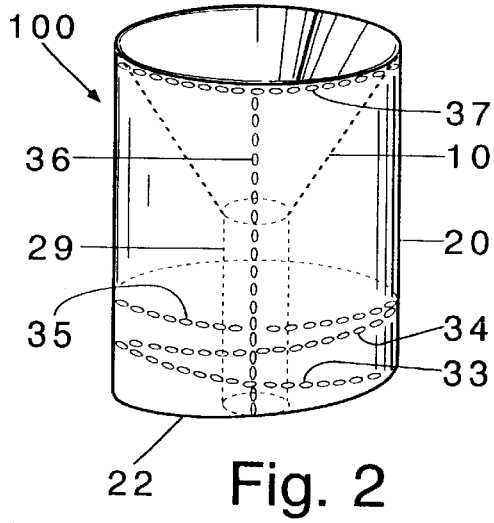
FIG. 2 is a plan view of the funnel of FIG. 1, modified from the first configuration seen in FIG. 1 to a second configuration.
Figure 3:
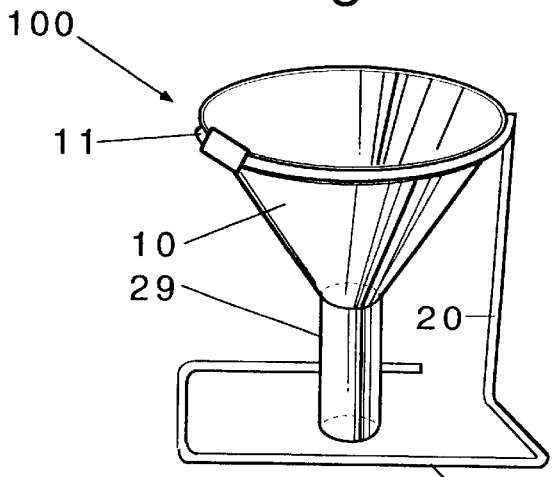
FIG. 3 is a plan view of another embodiment of a self-supporting, adjustable funnel of the invention.
Figure 4:
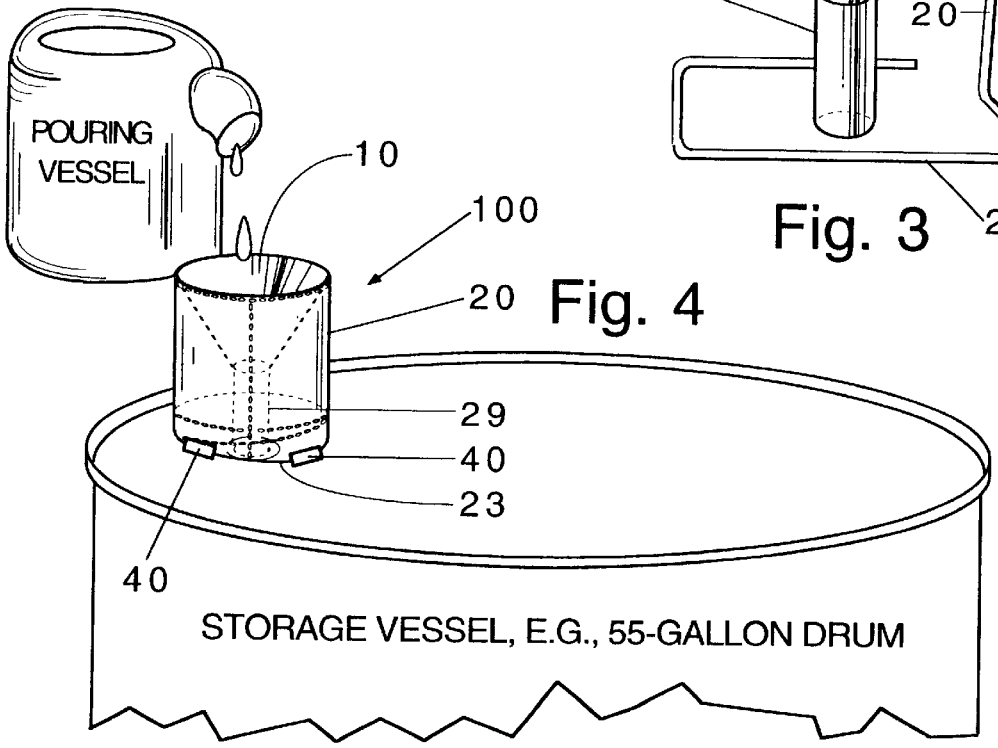
FIG. 4 is a plan view of the funnel of FIG. 1 in use in a third configuration.

With reference to the drawings, funnel device 100 includes funnel 10 and support 20. The device 100 may have the funnel 10 and support 20 made integrally as one piece (FIGS. 1, 2, 4); any suitable material may be used to make the funnel 10 or support 20 such as plastic, wood, paper, metal, concrete, and so forth. The device 100 may have separable support 20, for example, as by including as part of the funnel support-attaching adapter 11 such as a groove in which a suitable member such as a spring or wire may reside and be clipped or compressingly or otherwise attached, which can then function as the support 20 (FIG. 3) which may be adjustable as by shaping or bending, or by supplying another wire or spring support 20 made in another configuration; any suitable material such as noted above may serve as the funnel 10, and a plastic or even wood or cement may function as the wire or spring support 20. Adjustability may further be provided in a support by removing material from it. For example, first, lower support edge 21 of the support 20 can provide the device 100 with a first configuration with the edge 21 perpendicular to drain 29 of the funnel 20, and a second support edge 22 made from cutting, scoring, or perforations 32 about a lower conical section of the support 20 can provide a second configuration with the edge 22 oblique to the drain 29 of the funnel 20. Third, middle support edge 23 may be provided by cutting, scoring, or perforations 33 about another circumference line of the support 20 with the edge 22 perpendicular to the drain 29 and perhaps parallel to the first edge 21 but of a shorter height than provided by the first edge 21. The drain 29 may be cut shorter or left longer or as is. Fourth and fifth, even shorter support edges can be provided by cutting, scoring, or perforations 34 or 35, respectively, and so forth. In turn, so as to readily reach higher and higher support edge perforations, vertical cutting, scoring, or perforation line 36 may be provided, and a skirt-type support may be removed entirely by cutting uppermost cutting, scoring or perforations 37. Non-skid rest 40 may be attached to the bottom of a support, for example, rubber clips, which may otherwise be, say, a high-friction material in the form of a clip, ring, or paint. As a simple alternative, the non-skid rest may be provided by making the support 20 of a non-skid material.

CONCLUSION

The present invention is thus provided. Various features, parts, subcombinations and combinations may be employed with or without reference to other features, parts, subcombinations or combinations in the practice of the invention, and numerous modifications can be effected within its spirit, the literal claim scope of which is particularly pointed out as follows:

I claim:

1. A self-supporting and/or adjustable funnel device comprising a funnel having a drain to which is attached or has integrally therewith a support for holding the device in place, wherein:

the device is adjustable by having a contrivance added to or incorporated with the support to make it able to have its orientation vary from a first orientation;

the funnel and support are made integrally as one piece; and at least one of A and B as follows is present on the support:

(A) at least three cutting, scoring or perforation lines that are perpendicular to the drain of the funnel;

(B) at least one cutting, scoring or perforation line that is oblique to the drain of the funnel.

2. The device of claim 1, having perforated scoring lines.

3. The device of claim 1, which is adjustable by removing material from the device.

4. The device of claim 3, wherein a vertical cutting, scoring, or perforation line is provided.

5. The device of claim 3, wherein a skirt-type support can be removed entirely by cutting uppermost cutting, scoring, or perforations.

6. The device of claim 1, wherein a non-skid rest is attached to the bottom of the support.

7. The device of claim 6, wherein the non-skid rest includes rubber clips.

8. The device of claim 6, wherein the non-skid rest is in a form of a clip, ring, or paint.

9. The device of claim 1, wherein a non-skid rest is provided by making the support of a non-skid material.

10. A self-supporting and/or adjustable funnel device comprising a funnel to which is attached or has integrally therewith a support for holding the device in place, wherein:

the device is adjustable by removing material from the device; and a first, lower support edge of the support provides the device with a first configuration with the first lower support edge perpendicular to a drain of the funnel, and a second support edge about a lower conical section of the support can provide a second configuration with the second support edge oblique to the drain of the funnel.

11. The device of claim 10, wherein a third, middle support edge is provided about another circumference line of the support with the third, middle support edge perpendicular to the drain but of a shorter height than the first and second edges.

12. The device of claim 11, wherein a fourth support edge is provided above the third edge.

13. The device of claim 12, wherein a fifth support edge is provided above the fourth edge.

14. The device of claim 10, wherein a non-skid rest is present.

15. The device of claim 11, wherein a non-skid rest is present.

16. The device of claim 12, wherein a non-skid rest is present.

17. The device of claim 13, wherein a non-skid rest is present.

* * * * *